US006739665B1

(12) United States Patent
Leib et al.

(10) Patent No.: US 6,739,665 B1
(45) Date of Patent: May 25, 2004

(54) SEAT MOUNTING SYSTEM FOR A MOTION CHAIR

(75) Inventors: Roger K. Leib, Los Angeles, CA (US); Danny R. Hankins, Trinity, NC (US)

(73) Assignee: Krueger International, Inc., Green Bay, WI (US)

( * ) Notice: Subject to any disclaimer, the term of this patent is extended or adjusted under 35 U.S.C. 154(b) by 0 days.

(21) Appl. No.: 09/998,679

(22) Filed: Nov. 30, 2001

Related U.S. Application Data

(60) Provisional application No. 60/250,223, filed on Nov. 30, 2000.

(51) Int. Cl.[7] ..... A47C 1/02

(52) U.S. Cl. ..... 297/311; 297/317; 297/322

(58) Field of Search ..... 297/317, 318, 297/322, 342, 344.1, 313, 311, 332, 335, 326

(56) References Cited

U.S. PATENT DOCUMENTS

| | | | | | |
|---|---|---|---|---|---|
| 740,966 | A | * | 10/1903 | Wylie | 297/317 |
| 820,864 | A | * | 5/1906 | Hanger | 297/317 |
| 1,950,226 | A | | 3/1934 | Cable | |
| 2,303,308 | A | * | 11/1942 | McArthur | 297/317 |
| 2,374,848 | A | * | 5/1945 | Wohlk | 297/343 |
| 2,473,895 | A | * | 6/1949 | Mednick | 297/318 |
| 2,497,395 | A | * | 2/1950 | Cramer, Sr. | 297/318 |
| 2,553,445 | A | * | 5/1951 | Eckert et al. | 297/342 |
| 3,124,388 | A | * | 3/1964 | Berlin | 297/320 |
| 3,139,305 | A | * | 6/1964 | Mizelle | 297/317 |
| 4,045,081 | A | * | 8/1977 | Ueno | 297/317 |
| 4,784,435 | A | | 11/1988 | Leib | |
| 4,877,291 | A | * | 10/1989 | Taylor | 297/300.3 |
| 4,946,224 | A | | 8/1990 | Leib | |
| 4,966,411 | A | * | 10/1990 | Katagiri et al. | 297/300.7 |
| 5,066,069 | A | | 11/1991 | DeGelder | |
| 5,071,191 | A | | 12/1991 | Leib | |
| 5,288,126 | A | * | 2/1994 | Saul et al. | 297/85 |
| 5,522,182 | A | * | 6/1996 | Rogers | 52/9 |
| 5,551,758 | A | | 9/1996 | Leib et al. | |
| 5,570,927 | A | * | 11/1996 | LaPointe et al. | 297/85 |
| 6,102,477 | A | | 8/2000 | Kurtz | |
| 6,116,686 | A | | 9/2000 | Luo | |
| 6,494,540 | B1 | * | 12/2002 | Tornero | 297/440.1 |

* cited by examiner

*Primary Examiner*—Peter M. Cuomo
*Assistant Examiner*—Stephanie Harris
(74) *Attorney, Agent, or Firm*—Boyle, Fredrickson, Newholm, Stein & Gratz, S.C.

(57) ABSTRACT

A motion chair includes a pair of side frames, each of which has a front leg, a rear leg and a side rail brace member interconnected therebetween. A seat is located between the side frames, and includes a pair of resilient spring-type seat frames. A seat mounting arrangement interconnects each seat frame with one of the side frames. The seat mounting arrangement includes a bracket-type mounting member to which the seat frame is secured. A seat support member is interconnected with the side rail member, and the seat mounting member is secured to the support member. In one form, the seat support member is a metal reinforcement member connected to the side rail member, which is preferably formed of a wood material. The reinforcement member distributes loads and stresses applied to the seat mounting member to and throughout the length of the brace member. In another form, the seat support member is a planar side member that spans across a joint between the leg and the side rail member. The side member is mounted to the front leg and is connected to the side rail member at a location spaced rearwardly from the joint, to isolate the joint from loads and stresses applied to the side member. The seat mounting arrangement allows use of a motion-type seat mounting mechanism in a conventional wood frame chair having a side rail member, in a manner which isolates the chair frame connections from the loads and stresses applied to the seat mounting member when a user is seated on the seat.

10 Claims, 10 Drawing Sheets

SEAT MOUNTING SYSTEM FOR A MOTION CHAIR

This application is based on, and claims priority from U.S. provisional patent Application Serial No. 60/250,223, filed Nov. 30, 2000.

BACKGROUND AND SUMMARY OF THE INVENTION

This invention relates to a motion chair, and more particularly to an arrangement for mounting a seat to the legs or frame of a motion chair.

Motion type chairs are shown and described in Leib U.S. Pat. No. 4,784,435 issued Nov. 15, 1988 and U.S. Pat. No. 4,946,224 issued Aug. 7, 1990, as well as in Leib et al U.S. Pat. No. 5,551,758 issued Sep. 3, 1996, all of which are hereby incorporated by reference. The '435 patent discloses a motion chair having a metal frame that includes a pair of front legs, each of which has a mounting bracket attached to its inside area. A seat is mounted to the brackets, and includes side frame members which form both the seat support and back support areas of the chair. Each side frame member is connected to one of the mounting brackets, such that the seat is cantilevered at the front legs. The side frame members have spring action mechanical properties, to enable the seat support area to deflect downwardly and the back support area to deflect rearwardly and downwardly when an individual sits in the chair. The '191 patent discloses a similar arrangement, but in which each seat-mounting bracket is connected to a metal support bar, which in turn is anchored to the inside portion of one of the front legs, which are made of wood. This results in a combination wood-metal chair, in which seating loads are borne by the vertical portion of the front leg to which the support bar is attached.

The '758 patent discloses a motion chair having a metal frame, with a mounting bracket 14 being connected to each vertical upright leg portion of the frame. The seat includes a pair of side members, each of which is mounted to one of the brackets. As in the '435 patent, the side members have a spring action to impart motion to the seat and back of the chair.

In a metal frame chair, such as is disclosed in the '435 and '758 patents, the seat mounting support brackets are connected to the front legs of the chair by welding, wherein the weld connection and the metal front leg are capable of handling the loads and stresses resulting from a user sitting in the chair seat. In a wood frame chair, such as is disclosed in the '224 patent, the seat mounting brackets are welded to a vertical support bar, which in turn is connected to the vertical wood legs of the frame. The support bar functions to distribute loads and stresses applied to the support bar by the mounting bracket, throughout the length of the connection of the support bar to the vertical front portion of the wood frame. While this construction allows use of a motion-type connection in a wood frame chair, it is somewhat disadvantageous in that it requires a sturdy and strong front leg structure, which can detract from the aesthetic appearance of the chair and which provides limitations in design alternatives for a motion chair of this type.

It is an object of the present invention to provide a seat mounting arrangement for a motion chair, which does not rely solely upon connection of the chair frame mounting bracket to the vertical upright portion of a chair leg for support. It is a further object of the invention to provide such a seat mounting arrangement capable of being used in a chair having a conventional wood frame configuration, in which the size of the frame components is not dictated by the ability to handle loads and stresses applied on a seat mounting bracket, to which the seat is movably secured. It is a further object of the invention to provide such a seat mounting arrangement which can be used in any type of chair frame, to provide a wide variety of design options for a motion-type chair. A still further object of the invention is to provide such a seat mounting arrangement which is relatively simple in its components and construction, yet which provides highly satisfactory operation and a wide variety of design options.

In accordance with the invention, a motion-type chair includes a frame assembly having a pair of side frames, each of which has a front leg and a back leg. Each side frame further includes a side rail support member that extends in a front-rear direction. Each side rail support member is connected at a front end to one of the front legs, and at a rear end to one of the rear legs.

The motion-type chair further includes a seat adapted to support a user, which is typically in the form of a combination seat and back arrangement. The seat has a pair of side seat frame members, each of which is located adjacent one of the support members of the frame. Each seat frame member is preferably formed of a spring steel, as in the prior art, and is connected to a seat mounting bracket for providing resilient, biased movement of the seat relative to the frame assembly.

The present invention contemplates a seat support member that is interconnected with the side rail support member of each side frame. Each seat mounting bracket is connected to one of the seat support members, such as by welding. The seat support member extends in a front-rear direction. The seat support member is arranged so as to be located adjacent, and connected to, one of the side rail support members of the frame. In one form, the seat support member may be an elongated member applied to an edge or other surface of the side rail support member. The seat support member is preferably configured so as to correspond in shape to an edge portion of the side rail support member, so as to blend in with the side rail support member. This enables the seat support member to be incorporated into the chair frame without detracting from the overall appearance of the frame. This construction connects the seat mounting bracket to the frame without relying upon connection to the front leg of the frame to withstand all of the loads and stresses applied by a user sitting on the seat of the chair. In another form, the seat support member may be connected to an inside surface of the side rail support member. The seat support member may be configured to span the joint between the front leg and the side rail support member to avoid stressing the joint, and is preferably located so as not to be visible from the exterior of the frame.

In either form, the loads and stresses applied to the seat mounting bracket are transferred to the seat support member, and in turn are transferred to and absorbed by the side rail support member and the front and rear legs.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
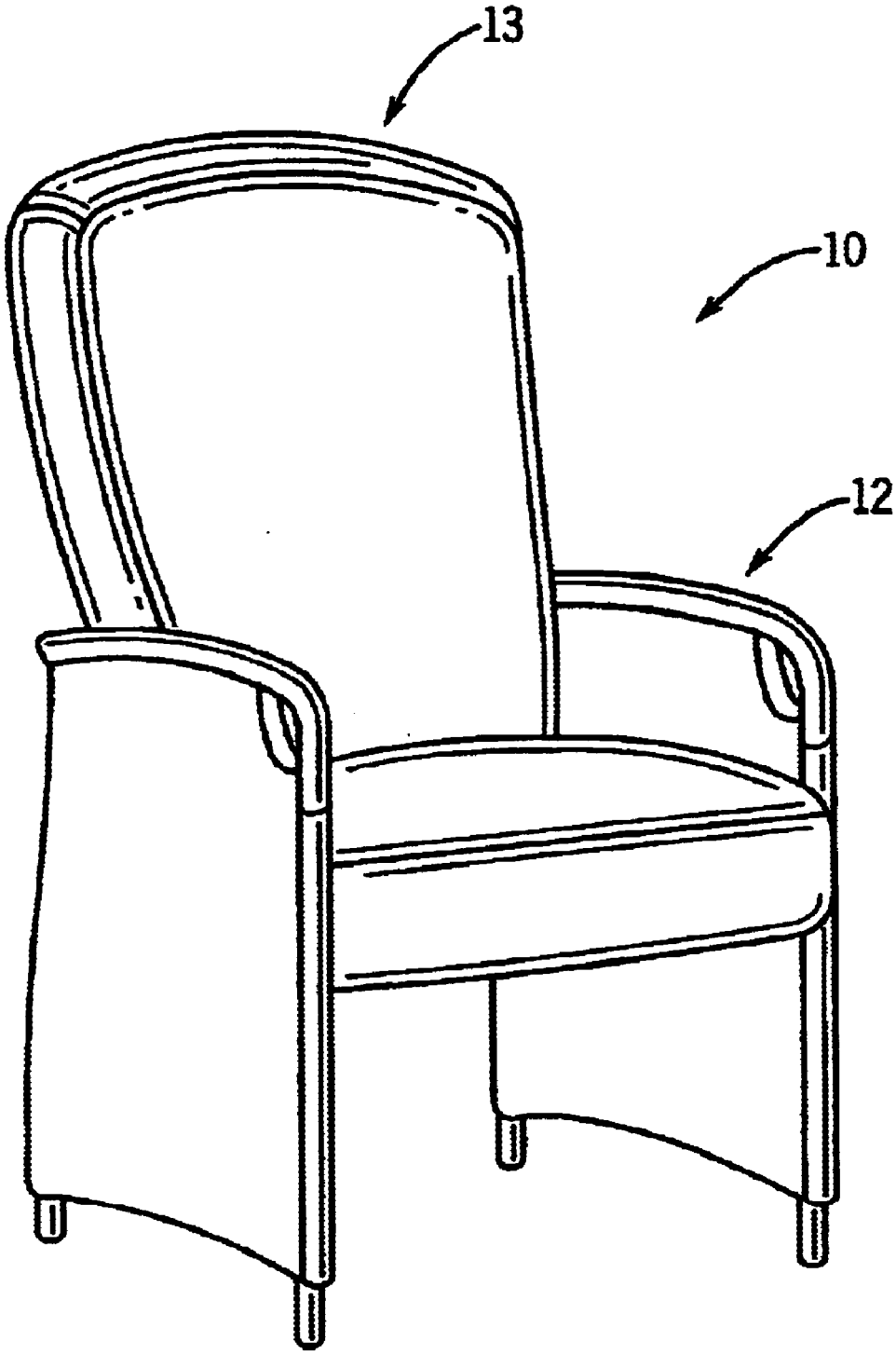
FIG. 1 is an isometric view of a motion chair incorporating the seat mounting system of the present invention.
Figure 2:
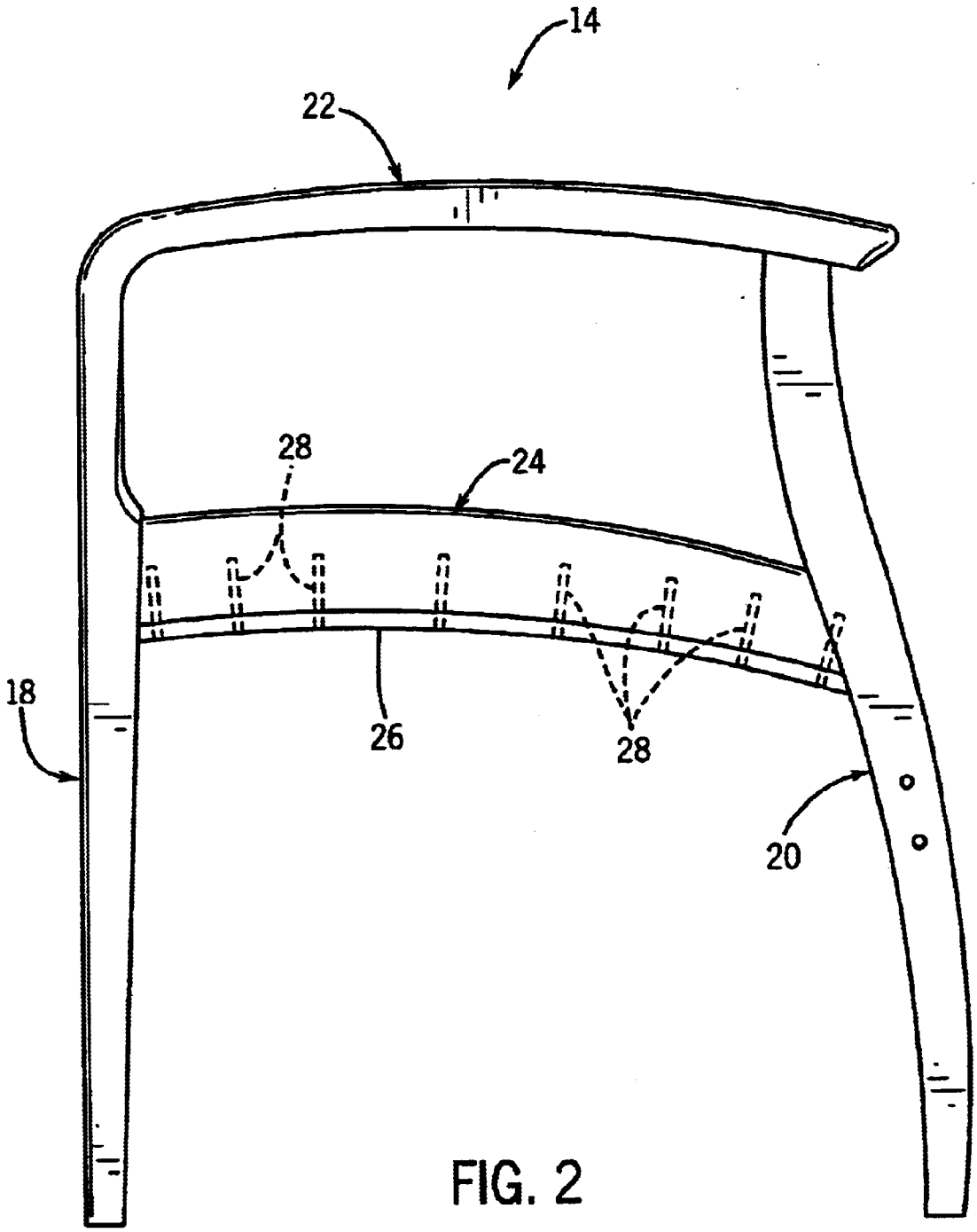
FIG. 2 is a side elevation view of a side frame incorporated into the motion chair of FIG. 1, for use in connection with a first embodiment of the seat mounting system of the present invention.
Figure 3:
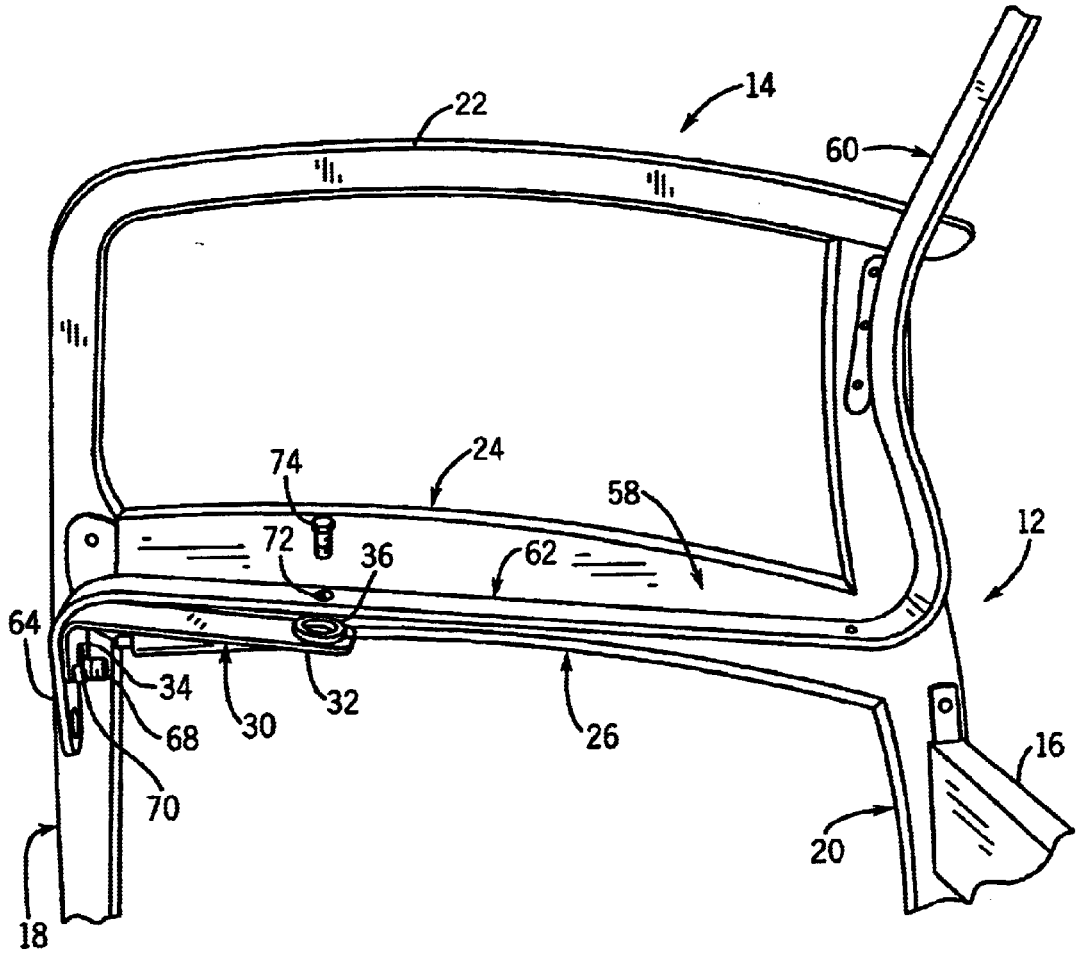
FIG. 3 is a view similar to FIG. 2, showing connection of a seat frame member to the side frame of FIG. 2, for mounting the seat and back to and between the side frame members for the chair of FIG. 1.
Figure 4:
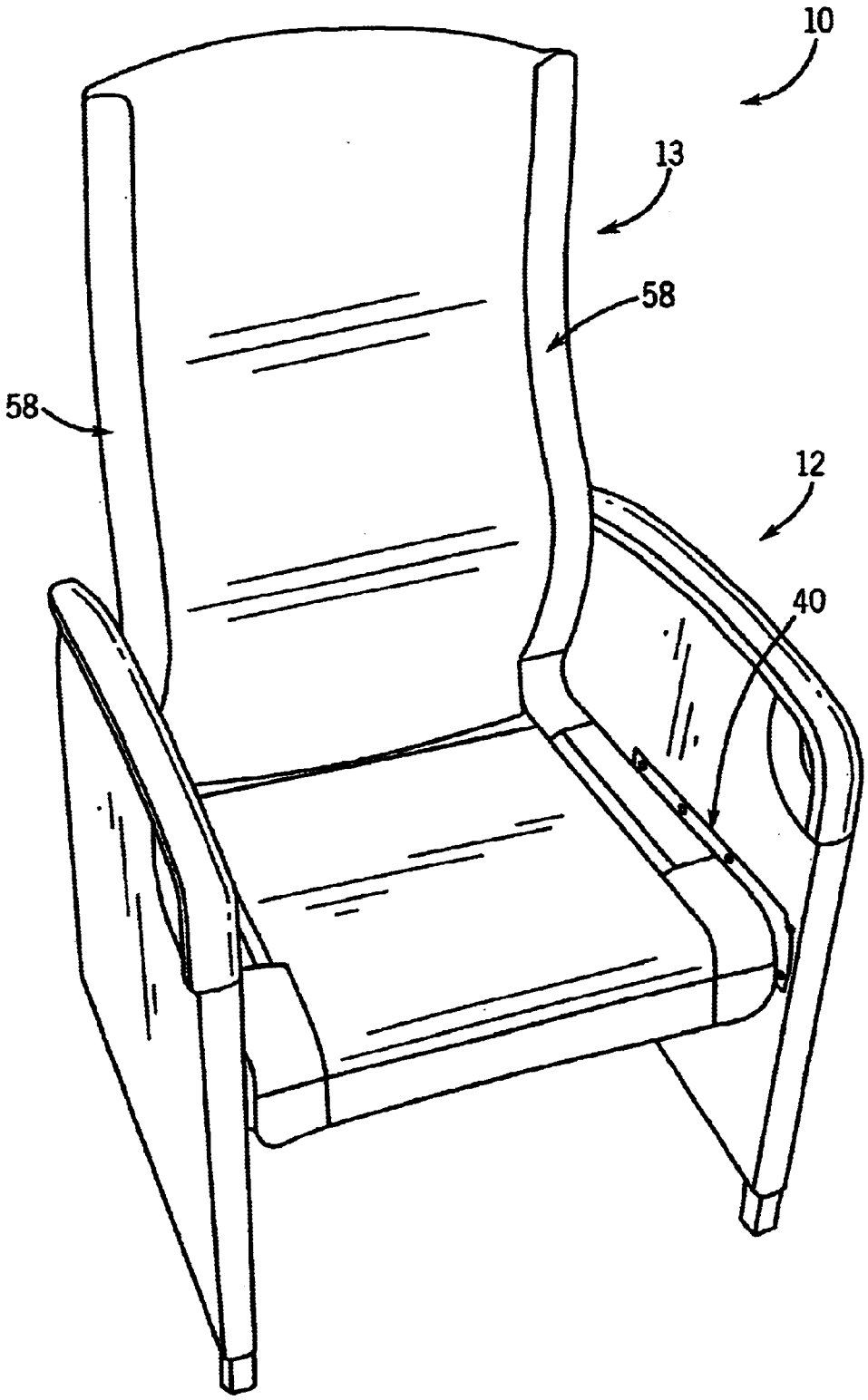
FIG. 4 is an isometric view of a motion chair similar to FIG. 1, incorporating a second embodiment of the seat mounting system of the present invention.

Referring to FIGS. 1–3, a chair 10 includes a frame assembly 12 and a seat arrangement or assembly 13. Frame assembly 12 has a pair of side frames 14 and a rear cross member 16. Each side frame 14 includes a front leg 18 and a rear leg 20. An arm 22 extends rearwardly from the upper end of each front leg 18, and is secured at its rearward end to the upper end of rear leg 20. A side support member or side rail 24 extends between front leg 18 and rear leg 20. These components of side frame 14 are formed and connected together using conventional techniques. In addition, rear cross member 16 is connected between the spaced apart rear legs 20 of side frames 14 in a conventional manner.

The invention contemplates a seat mounting arrangement for securing seat arrangement or assembly 13 to frame assembly 12. In a first embodiment of the invention, a seat support member in the form of a metal reinforcement member 26 is connected to the underside of each side rail 24. Reinforcement member 26 may be in the form of metal bar stock, or may have a rod or channel shape. A series of fasteners, such as threaded screws 28, extend upwardly through reinforcement member 26 and into side rail 24, to connect reinforcement member 26 to side rail 24. In an alternative configuration, reinforcement member 26 may be secured to any other surface of side rail 24, e.g. the inside surface, to conceal reinforcement member 26 from view.

In this embodiment, a seat mounting member, in the form of a seat mounting bracket 30, is connected to reinforcement member 26 in any satisfactory manner, such as by welding. Seat mounting bracket 30 is generally L-shaped, including a top leg 32 and a forward leg 34. A resilient bumper or spacer 36 is mounted to the upper surface of top leg 32, toward the rearward end of top leg 32. The weld connection of top leg 32 connects the outer edge of top leg 32 to the inner edge of reinforcement member 26, such that seat mounting bracket 30 extends inwardly from reinforcement member 26 and thereby from the inner surface of side rail 24. Seat mounting bracket 30 is generally constructed as shown and described in Leib et al U.S. Pat. No. 5,551,758. In this embodiment, a front cross-member extends between and interconnects front legs 18, and cooperates with side frames 14 and rear cross-member 16 to form a rigid frame assembly 12.

In a second embodiment of the invention, as shown in FIGS. 4—12, a seat mounting assembly or chassis 38 is adapted for engagement between side frames 14. Seat mounting assembly 38 generally includes a pair of seat support members in the form of side members 40, a pair of seat mounting members in the form of brackets 30, and a front cross member 44. Seat mounting assembly 38 extends between the front areas of side frames 14 and, in combination with rear cross member 16, functions to rigidly connect side frames 14 together. The components of seat mounting assembly 38 are preferably formed of metal and are assembled into a weldment or subassembly that is connected between side frames 14.

Each side member 40 is generally planar, and includes an elongated upper section 46 and a depending front section 48. A series of apertures 50 are formed in upper section 46 and front section 48. Side member 40 is shaped such that its lower edge corresponds to the contour of the lower surface of reinforcement member 26.

Each seat mounting bracket 30 is connected to its associated side member 40 so as to extend inwardly from the inner surface of side member 40. Each seat mounting bracket 42 is constructed as set forth above, including top leg 32 and forward leg 34. Forward leg 34 includes a notch 56 extending upwardly from its lower edge.

Front cross member 44 extends between and interconnects side members 40 and seat mounting brackets 42. Front cross member 44 has an arcuate downward curvature between its ends, and each end is welded to the underside of one of mounting bracket top legs 32 and to the inner surface of side member upper section 46 to which the seat mounting bracket 42 is mounted.

Figure 5:
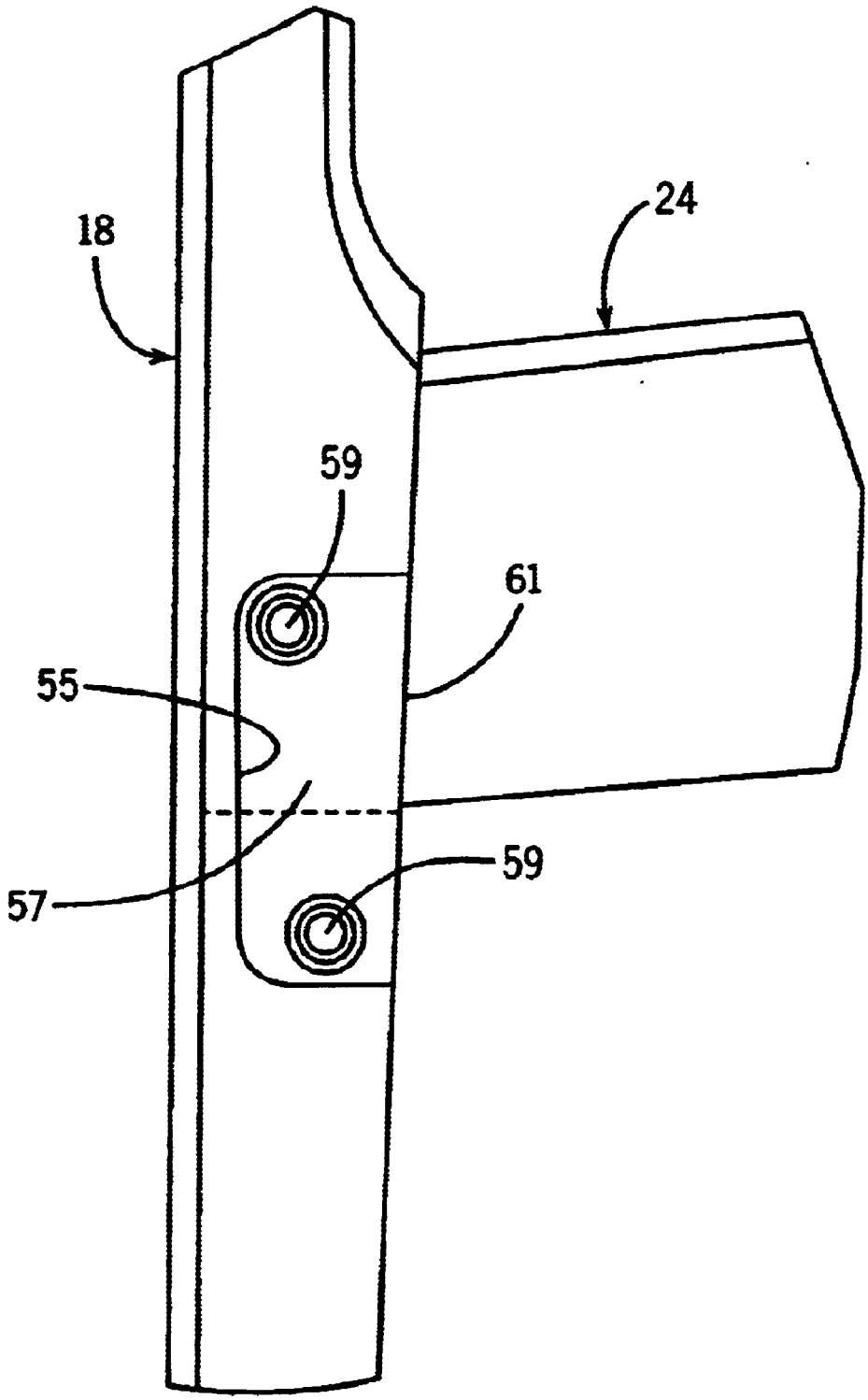
FIG. 5 is a partial elevation view illustrating a leg and side rail construction for the a seat mounting system incorporated into the chair of FIG. 4.
Figure 6:
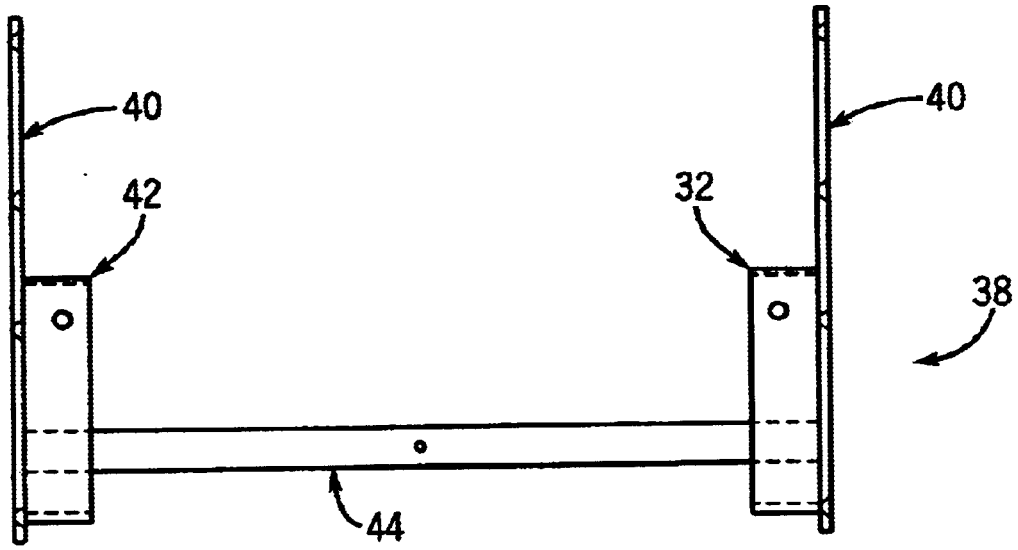
FIG. 6 is a top plan view of a seat support assembly adapted for mounting to and between the side frames of the chair of FIG. 4.
Figure 7:
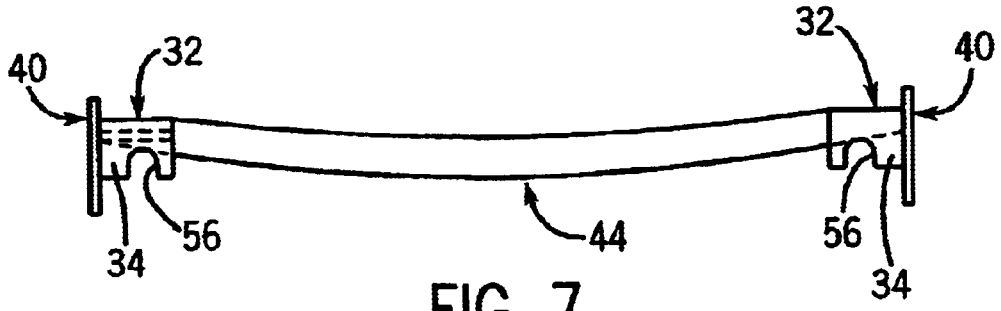
FIG 7 is a front elevation view of the seat support assembly of FIG. 5.
Figure 8:
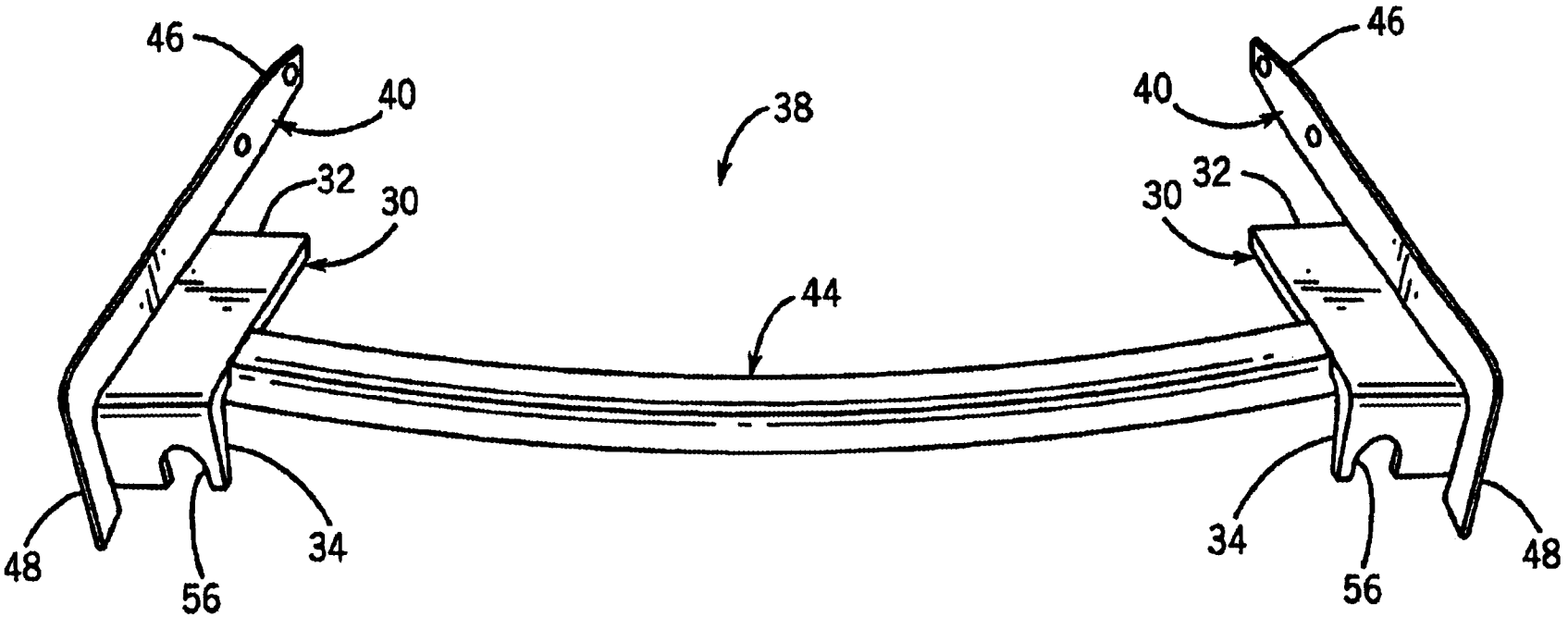
FIG. 8 is a perspective view of the seat support assembly of FIGS. 6 and 7.
Figure 9:
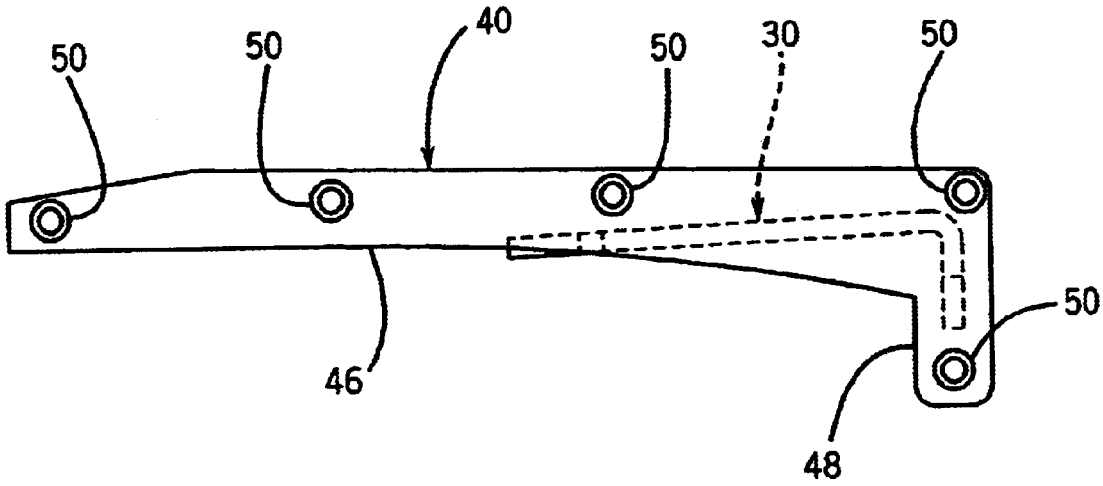
FIG. 9 is a side elevation view of the seat support assembly of FIGS. 6–8.
Figure 10:
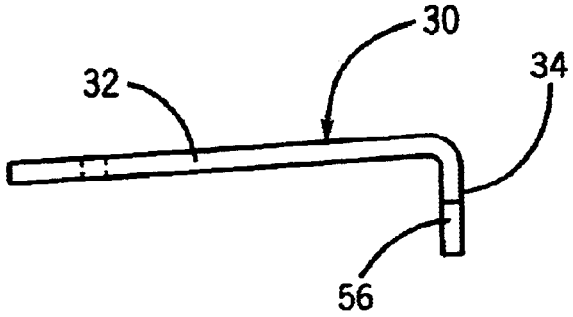
FIG. 10 is a side elevation view of a seat mounting bracket member incorporated in to the seat support assembly of FIGS. 6–9.
Figure 11:
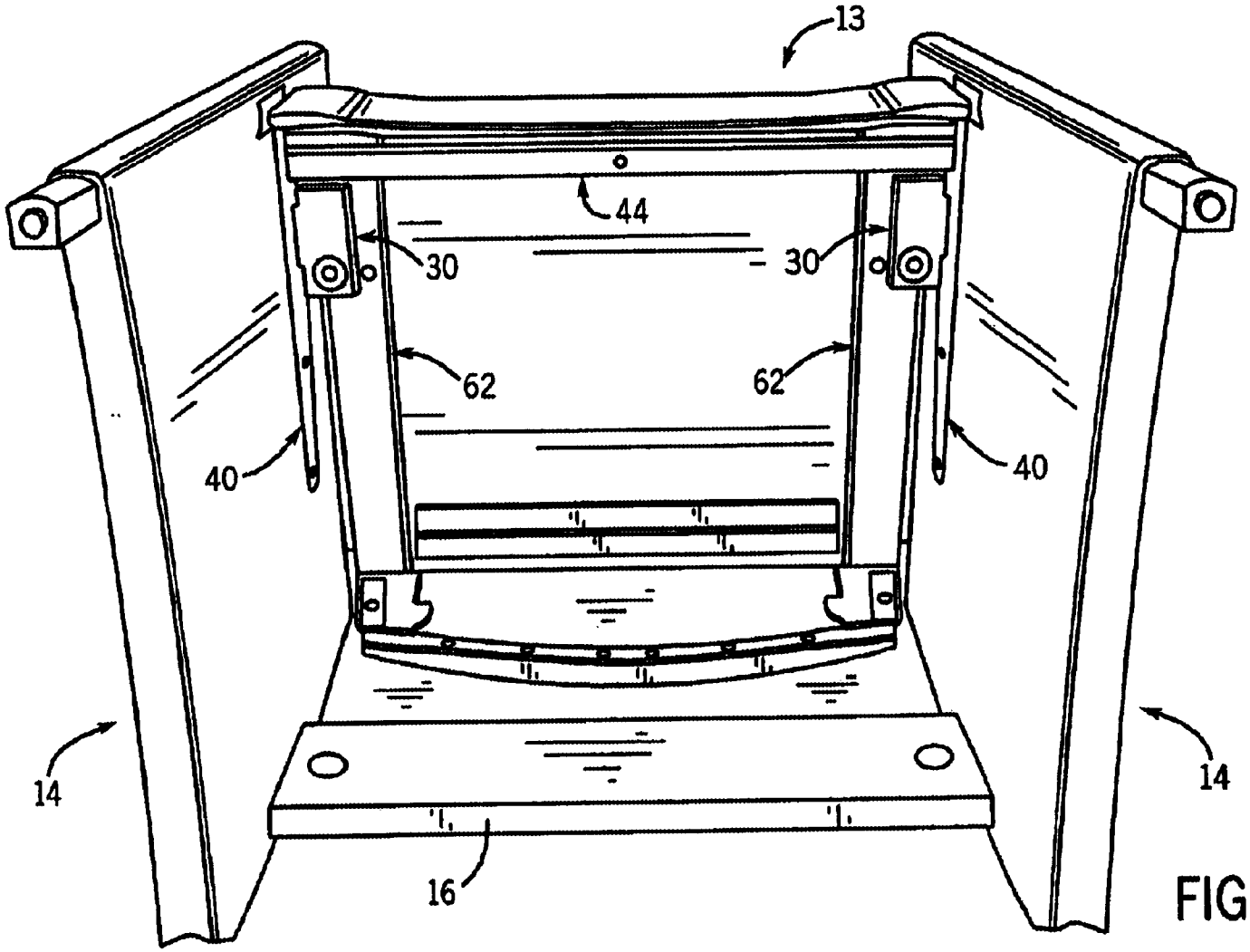
FIG. 11 is a perspective view of the underside of the motion chair of FIG. 4.
Figure 12:
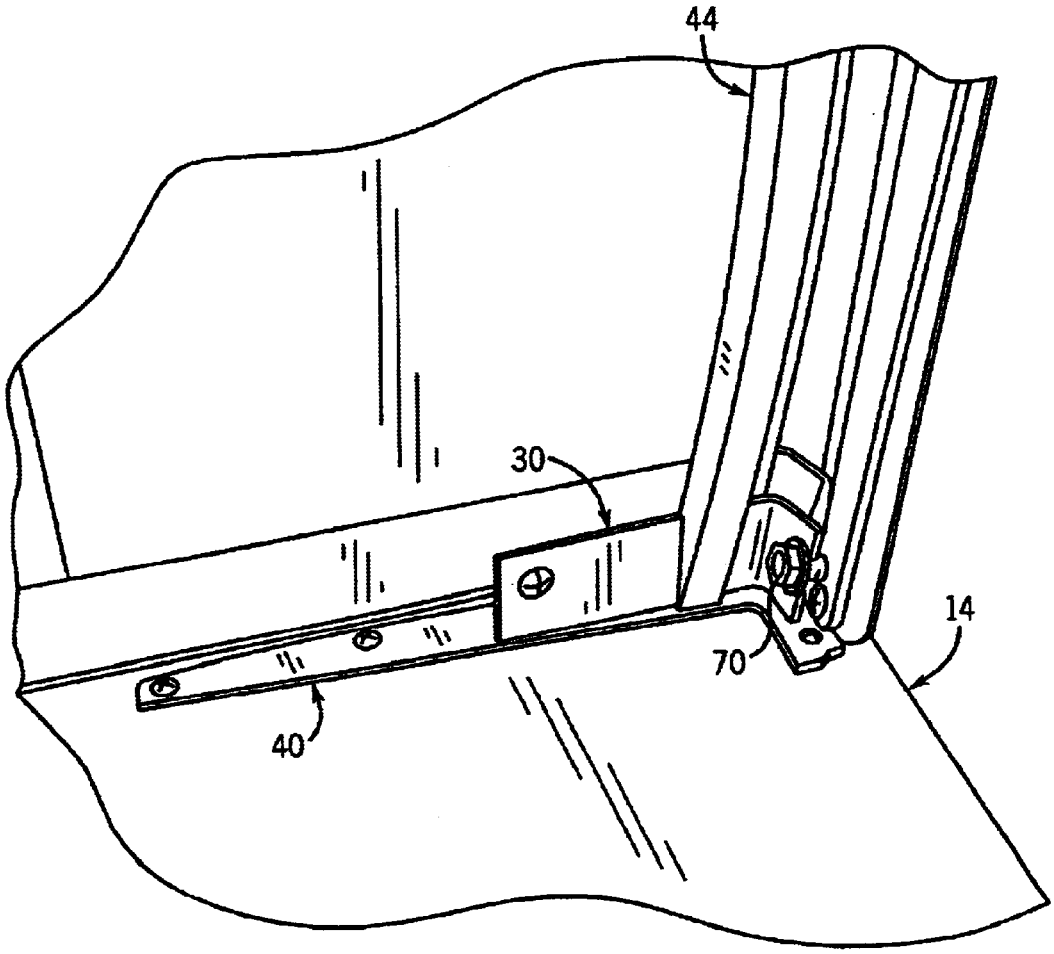
fig. 12 is an enlarged perspective view showing a portion of the underside motion chair of FIG. 4.

Each front leg 18 has a greater thickness than its associated side rail 24. As shown in FIG. 5, a recess 55 is formed in the inner surface of leg 18 forwardly of the connection of side rail 24 to leg 18. Recess 55 has a depth sufficient to form a recess floor 57 that is flush with the inner surface of leg 18. A pair of bores 59 extend into leg 18 inwardly from recess floor 57.

In assembly, seat mounting assembly 38 is secured between the forward portions of side frames 14 by positioning side members 40 such that the upper section 46 of each side member 40 is placed against the inner surface of its respective side rail 24, and the front section 48 is engaged within recess 55 in front leg 18 and engages recess floor 57. In this manner, side member spans across the joint, shown at 61, between side rail 24 and leg 18. The forward pair of vertically spaced apertures 50 are in alignment with bores 59 in leg 18, and side member upper section 46 extends rearwardly along side rail 24, in engagement with the inside surface of side rail 24. Side member 40 is dimensioned such that its upper section 46 extends throughout more than half of the length of side rail 24. Threaded fasteners, such as screws, are inserted through the vertically spaced forward pair of apertures 50 and the aligned bores 59 in front leg 18, and also through the remaining apertures 50 through the inner surface of brace member 24 and into the material of brace member 24. Each side member 40 is positioned such that the lower edge of its upper section 46 is aligned with the lower edge of side rail 24. In this manner, each side member 40 is concealed from sight when side frame 46 is viewed from the outside. Front cross member 44 has a length which is operable to space front legs 18 apart a distance substantially equal to the spacing of rear legs 20 provided by rear cross member 16, and rigidly connects frame assembly 12 together.

Seat arrangement or assembly 13 is common to both seat support member embodiments, and includes a pair of seat side members 58 (FIGS. 3, 4), which are generally in the form of resilient metal frame members constructed in a known manner. Conventional structural members, cushioning and upholstery are attached between seat side members 58, to form a seat section for supporting a user's seat area as well as a back section for supporting a user's back area. While the seat of chair 10 is disclosed as having a seat section and back section formed together, it is also understood that the chair may be formed so as to have only a movable seat section, and the back section may be connected to chair frame assembly 12 independent of the seat section.

In the disclosed embodiment, each seat side member 58 includes an upstanding back section 60 and a seat section 62 located adjacent one of side frames 14. A mounting section 64 extends downwardly from the forward end of seat section 62, and includes an opening adapted for placement into alignment with notch 56 in forward leg 34 of one of seat mounting brackets 30. A connector arrangement, in the form of a threaded bolt 68, extends through the aligned notch 56 and opening in mounting section 64. A nut 70 is threaded onto the shank of bolt 68, such that bolt 68 and nut 70 function to securely engage mounting section 64 with seat mounting bracket 42. The forward area of seat section 62 overlies top leg 32 of seat mounting bracket 30. Spacer 36 is engaged with top leg 32 of seat mounting bracket 30. Spacer 36 defines a central opening, and a threaded receiver, such as a weld nut, is secured to the underside of top leg 32, defining a threaded passage in alignment with the opening in spacer 36. An aligned aperture is formed in top leg 32, and an aperture 72 is formed in the forward area of seat section 62. A connector, such as a screw 74, extends through aperture 72 and the aligned spacer opening and aperture in top leg 32, into threaded engagement with the weld nut secured to the underside of top leg 32. In this manner, the forward area of seat section 62 is securely mounted to seat mounting bracket 30. Spacer 36 thus forms a fulcrum for the rearward portions of seat section 62 and back section 60 of seat side frame 58.

In either embodiment, and in a manner as is known in the art, the seat side frame members 58 are cantilevered from the mounting brackets 30, so that the rearward area of the seat assembly 13 is unsupported between the side frames 14. The spring steel material of seat side frame members 58 functions to bias the rearward area of seat assembly 13 upwardly. In this manner, the rearward area of seat assembly 13 is capable of upward and downward movement when a user sits on seat assembly 13, by movement of the seat side frame members 58 relative to side frames 14.

In operation, when a user is seated on seat assembly 13 of chair 10, the torsional and vertical loads applied to each seat mounting bracket 30 are applied to the seat support member, and in turn are transferred to frame side rail 24 at a location spaced rearwardly from the joint between side rail 24 and leg 18. In the embodiment of FIGS. 2 and 3, the loads applied to seat mounting bracket 30 are transferred through the weld connection of seat mounting bracket top leg 32 to reinforcement member 26. Such loads are distributed along the length of reinforcement member 26, so as not to stress the joints between side rail 24 and front and rear legs 18, 20, respectively. In the embodiment of FIGS. 4–11, such loads are transferred to the side member 40 through the connection of seat mounting bracket 30 to side member 40. In turn, such loads are transferred to side rail 24 through side member 40. Because side member 40 spans across joint 61 between leg 18 and side rail 24 and throughout a majority of the length of side rail 24, joint 61 is isolated from torsional and shear stresses applied to side member 40. The stresses experienced by side member front section 48 are primarily shear stresses, which are transferred directly to front leg 18. The torsional and shear stresses applied to side member upper section 46 are transferred to side rail 24 through the screws extending through apertures 50 formed in upper section 46, which are spaced sufficiently rearwardly of joint 61 so as to distribute such stresses to side rail 24 in a manner which avoids excess stress on joint 61. In both embodiments, the torsional stresses applied to seat mounting bracket 30 are transferred to side rail 24 at a location spaced a sufficient distance rearwardly from joint 24 so as to isolate joint 61 from such stresses.

The configuration and function of the seat support member embodiments of the present invention enables use of a motion-type seat mounting arrangement in a wood frame chair having a conventional leg and side rail design. The structure by which the seat mounting brackets are connected to the legs and side rails functions to mount the seat between the side frames and to distribute loads to the various side frame components, using a structure which can be blended into and concealed by the components of the frame. The invention thus enables a motion-type seat mounting arrangement to be incorporated into a wide variety of wood frame styles and designs, without detracting from the aesthetic appearance of the chair and without requiring significant alteration in the construction or design of the joint between the side rail and the legs of the frame.

While the invention has been shown and described with respect to a particular embodiment, it is understood that variations are possible without departing from the spirit and scope of the invention. For example, and without limitation, it is contemplated that front cross member 44 of seat mounting assembly 38 may be eliminated, and a separate cross member or other structure may be employed to interconnect front legs 18. In this version, the side members 40 are separate from each other, and each is separately mounted to its respective side frame 14. It is also contemplated that each embodiment may be used in connection with any type of motion-type seat mounting arrangement, and is not limited to the specific seat mounting bracket and seat frame construction as shown and described. It is also contemplated that this type of mounting arrangement may be employed in a metal frame chair in which a metal side rail member extends between front and rear legs. Each seat mounting bracket 30 may be connected to the metal side rail member at a location between the legs, such that the metal brace member itself functions to distribute the loads applied to the seat mounting bracket, and to transfer the resultant stresses into the connection of the metal side rail to the front and rear legs.

Various alternatives and embodiments are contemplated as being within the scope of the following claims particularly pointing out and distinctly claiming the subject matter regarded as the invention.

What is claimed is:

1. A motion chair, comprising:

a frame assembly including a pair of side frames, wherein each side frame includes a front leg defining a lower end, a rear leg defining a lower end, and a side rail member extending in a front-rear direction and interconnecting the front and rear legs, wherein the side rail member defines a forward end secured to the front leg and a rearward end secured to the rear leg and is located above the lower ends of the front and rear legs, and wherein the lower ends of the front and rear legs are adapted to engage a supporting surface for supporting the chair on the supporting surface;

a seat arrangement located between the side frames, wherein the seat arrangement includes a pair of spaced apart seat side members each of which includes a rear area and a forward connection area; and a seat support arrangement interconnected with each seat side member, wherein the seat support arrangement includes a seat mounting member and a seat support member, wherein the seat mounting member is mounted to the seat support member, and wherein the seat support member is interconnected with the side rail member at a location rearward of the front leg;

wherein the forward connection area of each seat side member is secured to one of the seat mounting members, and wherein the rear area of each seat side member is unsupported between the side frames of the frame assembly, wherein the seat arrangement is supported by the forward connection areas of the seat side members to enable the seat arrangement to move upwardly and downwardly between the side frames by upward and downward movement of the rear areas of the seat side members relative to the side frames.

2. The motion chair of claim 1, wherein the seat support member comprises a reinforcement member connected to the side rail member along substantially the entire length of the side rail member between the front and rear legs, to distribute loads applied to the seat mounting member throughout the length of the side rail member, and wherein each seat mounting member extends inwardly from one of the reinforcement members.

3. The motion chair of claim 1, wherein the seat support member comprises a side member connected to the side rail member, wherein the seat mounting member is secured to the side member.

4. The motion chair of claim 3, wherein the side member includes a forward section secured to the front leg and a rearward section secured to the side rail member, and wherein the side member is configured to span across a joint located between the front leg and the side rail member.

5. The motion chair of claim 4, wherein the rearward section extends in a front-rear direction from the forward section, and wherein the rearward section overlies and is connected to the side rail member.

6. In a motion chair including a seat having a pair of seat said members, each of which defines a forward area and a rearward area, and wherein each seat side member is located adjacent a side frame having a front leg defining a lower end, a rear leg defining a lower end, and a side rail member extending between the front and rear legs and located above the lower ends of the front and rear legs, wherein the side rail member defines a forward end secured to the front leg at a forward joint, the improvement comprising a seat mounting member connected to each side rail member at a location rearward of the forward joint, wherein the forward area of each seat member is secured to one of the seat mounting members and wherein the rear area of each seat side member is unsupported such that the seat is movable upwardly and downwardly between the side frames and is supported by the seat mounting members at the forward areas of the seat side members, wherein the connection of each seat mounting member to one of the side rail members rearward of the forward joint functions to transfer loads from the seat mounting member to the side rail member.

7. The improvement of claim 6, wherein the side rail member includes a first section formed of a wood material and a metal reinforcement section secured to the first wood section, wherein the metal reinforcement section extends rearwardly from the forward joint, and wherein the seat mounting member is secured to the metal reinforcement section of the side rail member.

8. The improvement of claim 6, wherein the seat mounting member includes a forward section located adjacent the front leg, and wherein the seat mounting member is secured to the seat side member via a seat support member having a forward area that overlies and is secured to at least a portion of the front leg, wherein the seat support member extends rearwardly from the forward area and extends rearwardly of the forward joint between the side rail member and the front leg, and wherein the forward section of the seat mounting member is interconnected with the forward area of the seat support member.

9. The improvement of claim 8, wherein the seat support member comprises a substantially planar side member to which one of the seat mounting members is secured.

10. The improvement of claim 9, wherein the seat mounting member includes a rearward section extending rearwardly from the forward section, and wherein the seat side member overlies the rearward section of the seat mounting member and is secured to an engagement member mounted to the rearward section of the seat mounting member for engaging the seat side member with the rearward section of the seat mounting member.

* * * * *

UNITED STATES PATENT AND TRADEMARK OFFICE

CERTIFICATE OF CORRECTION

PATENT NO. : 6,739,665 B1
DATED : May 25, 2004
INVENTOR(S) : Roger K. Leib et al.

It is certified that error appears in the above-identified patent and that said Letters Patent is hereby corrected as shown below:

Column 7,
Line 47, delete "said" and substitute therefore -- side --;

Column 8,
Line 10, after "seat" (2nd occurrence) insert -- side --.

Signed and Sealed this

Seventh Day of September, 2004

JON W. DUDAS
*Acting Director of the United States Patent and Trademark Office*